United States Patent [19]

Eto et al.

[11] Patent Number: 4,639,721

[45] Date of Patent: Jan. 27, 1987

[54] DATA SELECTION CIRCUIT FOR THE SCREEN DISPLAY OF DATA FROM A PERSONAL COMPUTER

[75] Inventors: Masayuki Eto, Yaita; Kazuyoshi Izumi; Fuyuki Kobayashi, both of Utsunomiya; Mamoru Kawagishi; Masahiro Oosawa, both of Yaita, all of Japan

[73] Assignee: Sharp Kabushiki Kaisha, Osaka, Japan

[21] Appl. No.: 536,965

[22] Filed: Sep. 29, 1983

[30] Foreign Application Priority Data

Oct. 9, 1982 [JP] Japan ..... 57-177990
Oct. 12, 1982 [JP] Japan ..... 57-179248

[51] Int. Cl.[4] ..... G09G 3/16

[52] U.S. Cl. ..... 340/747; 340/703; 340/748; 340/750; 340/799

[58] Field of Search ..... 340/703, 721, 745, 750, 340/748, 747, 798, 799, 802

[56] References Cited

U.S. PATENT DOCUMENTS

| | | | |
|---|---|---|---|
| 4,404,552 | 9/1983 | Hirahata et al. | 340/750 |
| 4,450,442 | 5/1984 | Tanaka | 340/745 |
| 4,470,042 | 9/1984 | Barnich et al. | 340/745 |
| 4,486,746 | 12/1984 | Walker | 340/750 |
| 4,490,797 | 12/1984 | Staggs et al. | 340/703 |
| 4,498,081 | 2/1985 | Fukushima et al. | 340/721 |
| 4,504,826 | 3/1985 | Leininger | 340/745 |

*Primary Examiner*—Gerald L. Brigance
*Attorney, Agent, or Firm*—Birch, Stewart, Kolasch & Birch

[57] ABSTRACT

This invention provides a RAM data selection circuit in which the screen data from the graphic display RAM and the text display RAM incorporated in the personal computer are simultaneously outputted and a data selection means adapted to output either of the two screen data preferentially by the dot unit to the monitor TV is provided, thereby rapidly enabling the superimposing of graphic and text data on the screen.

2 Claims, 5 Drawing Figures

FIG. 3

| COLOR | R | G | B |
|---|---|---|---|
| BLACK | 0 | 0 | 0 |
| RED | 0 | 0 | 1 |
| GREEN | 0 | 1 | 0 |
| YELLOW | 0 | 1 | 1 |
| BLUE | 1 | 0 | 0 |
| MAZENTA | 1 | 0 | 1 |
| CYAN | 1 | 1 | 0 |
| WHITE | 1 | 1 | 1 |

FIG. 4

| R | C | B | $OUTPUT_S$ |
|---|---|---|---|
| 0 | 0 | 0 | D0 |
| 0 | 0 | 1 | D1 |
| 0 | 1 | 0 | D2 |
| 0 | 1 | 1 | D3 |
| 1 | 0 | 0 | D4 |
| 1 | 0 | 1 | D5 |
| 1 | 1 | 0 | D6 |
| 1 | 1 | 1 | D7 |

FIG. 5

| COLOR | R | G | B | OUTPUT S |
|---|---|---|---|---|
| BLACK | 0 | 0 | 0 | 1 |
| RED | 0 | 0 | 1 | 0 |
| GREEN | 0 | 1 | 0 | 1 |
| YELLOW | 0 | 1 | 1 | 1 |
| BLUE | 1 | 0 | 0 | 0 |
| MAZENTA | 1 | 0 | 1 | 0 |
| CYAN | 1 | 1 | 0 | 1 |
| WHITE | 1 | 1 | 1 | 0 |

DATA SELECTION CIRCUIT FOR THE SCREEN DISPLAY OF DATA FROM A PERSONAL COMPUTER

BACKGROUND OF THE INVENTION

This invention concerns a system for the selective display of RAM data in a case where digital data such as from a personal computer are displayed on a monitor screen, as well as to a data selection circuit therefor. More specifically, it relates to a RAM data selection circuit which is required for outputting both of the contents in a graphic display RAM storing the data of the screen by the dot unit and a text display RAM storing the dots of the screen by the block unit and superimposing them on a monitor screen.

FIG. 1 is a basic conceptional view for the display of data from a personal computer as the background of this invention, wherein there are shown a personal computer 1 incorporating a microcomputer, a keyboard 2 providing the personal computer 1 with input information and a color television monitor 3 having a television circuit 3*a* and raster-scan type CRT 3*b* driven from the television circuit 3*a*. When R.G.B signals are applied together with a sync signal (CY) from the personal computer 1 to the color television monitor 3, data can be displayed by way of a matrix circuit 3*aa* in the television circuit 3*a* on the CRT 3*b*. The color television monitor 3 may be a recently commercialized color television receiver for home use having an RGB terminal as well as an exclusive monitor. The data displayed on the monitor screen are those data stored in RAMs incorporated in the personal computer 1.

In the case of displaying dot data on the monitor screen, dots for the screen may be processed dot by dot individually, or several dots may be processed collectively in a unit of one block. In the case of dot by dot processing, if one bit of the data is allocated to one dot, a memory capacity for the number of bits corresponding to the dots is required. For instance, in the case of a 640×200 dot screen, memory capacity of 128,000 bits is required. When all of the dots of the screen are allocated to the bits of the memory, this memory is called a graphic RAM. Conversely, in a case where several dots are processed in one block, a code corresponding to the block is composed of several bits of data (for instance, 8 bits) and the code data is stored in the memory. This memory is referred to as a text RAM. In this case, the memory capacity can be reduced as compared with the former graphic RAM. For instance, in a case where an 8 dot×8 dot block is replaced with a code data composed of 8 bits, the number of 64 bits required in the former can be reduced to 8 bits in the latter. In the same way, 2000 bits of capacity is sufficient for the case of 640×200 dots. The disadvantage in the latter system is that it requires a character generator and a parallel-serial converter, and in that it can not perform fine control on every dot.

In a case where the personal computer 1 (FIG. 1) has both the text display RAM and the graphic display RAM, the data from these RAMs are simultaneously outputted by transferring the content in the text display RAM once into the graphic display RAM and, thereafter, reading them out of the graphic display RAM to the screen. The conventional system involves a problem that a considerable period of time is required for the transfer of the text data and high speed output to the screen is impossible. Furthermore, since the text data are once loaded into the graphic RAM, it lacks in a sufficient degree of freedom on superimposing both of the data as viewed from the screen thereby necessarily providing only a monotonous screen display.

SUMMARY OF THE INVENTION

The principal object of this invention is to superimpose the graphic display RAM data and the text display RAM data at a high speed when viewed from the monitor screen and enable high speed output of the superimposed result on the monitor screen.

Another object of this invention is to extend the degree of freedom for superimposing the graphic display RAM data and the text display RAM data, and to optionally control the degree of freedom.

A further object of this invention is to provide a data selection means for preferentially outputting either the graphic display RAM data or the text graphic display RAM data by the dot unit and further enable to monitor responsive to the data selection.

A still further object of this invention is to obtain stereoscopic images by providing a priority order for a plurality of display colors upon displaying the data from a personal computer or the like on a television CRT.

Other objects and further scope of applicability of this invention will become apparent from the detailed description given hereinafter. It should be understood, however, that the detailed description and specific examples, while indicating preferred embodiments of the invention, are given by way of illustration only, since various changes and modification within the spirit and scope of the invention will become apparent to those skilled in the art from this detailed description.

The principal feature of this invention resides in that a data selection circuit comprises a preferential switching means for outputting the screen data simultaneously from a graphic display RAM and a text display RAM, and for switching the preferential output of the two data by the dot unit to a television monitor, so that both the screen data can be superimposed instantaneously when viewed on the monitor screen.

In summary, the data selection means according to this invention, adapted to issue a switching signal for the preferential output of the two screen data by the dot unit comprises a RAM means having an output data from the graphic display RAM as an address input, supplied with data from a microcomputer by way of a data bus as a data input.

BRIEF DESCRIPTION OF THE DRAWINGS

This invention will be better understood from the detailed description given hereinbelow and the accompanying drawings which are given by way of illustration only, and thus are not limitative of this invention and wherein:

FIG. 3 is a chart showing a correlation between RGB outputs and colors in the form of a table; and FIG. 4 and FIG. 5 are charts showing examples of the RGB outputs and the switching signal S for a graphic display RAM respectively.

DETAILED DESCRIPTION OF THE INVENTION

Figure 1:
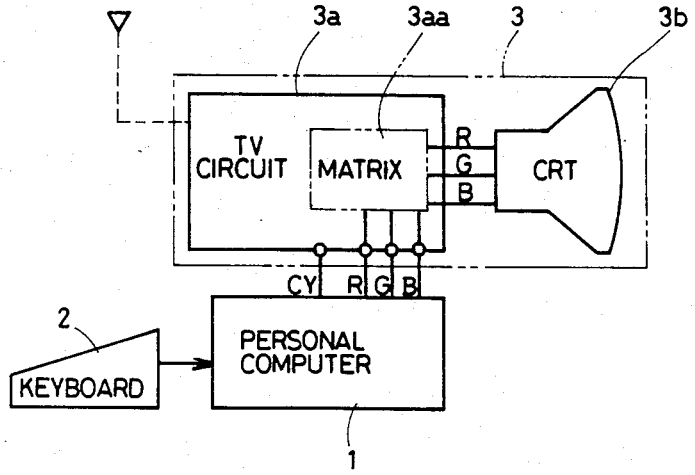
FIG. 1 is a basic conceptional view showing the background of this invention.
Figure 2:
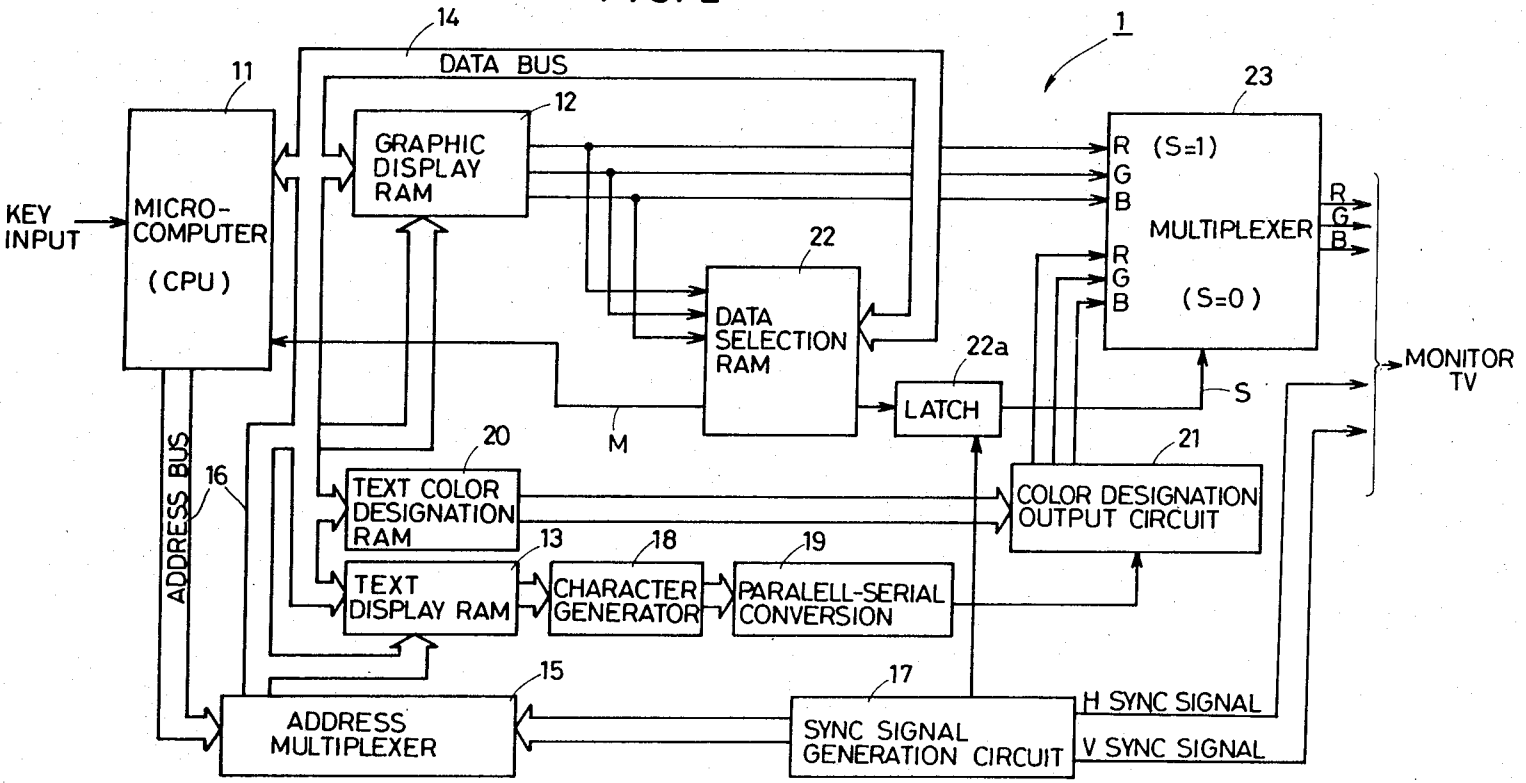
FIG. 2 is a block diagram for a preferred embodiment of this invention.

FIG. 2 shows a block diagram for a preferred embodiment of this invention.

A small type electronic computer 1 including a microcomputer (hereinafter referred to as "CPU") 11 supplied with key inputs comprises a graphic display RAM 12 and a text display RAM 13. The graphic display RAM 12 and the text display RAM 13 are connected by way of a data bus 14 to the CPU 11 and by way of an address multiplexer 15 to an address bus 16. Control lines from the CPU 11 are actually connected to both of the RAMs 12, 13 but, since this is a well known manner of control, the control lines are not illustrated.

The CPU 11 distinguishes digital signals and, depending on the content thereof, designates addresses to the graphic display RAM 12 and the text display RAM 13 to load therein required data for the display. The address multiplexer 15 functions as a switch for switching the graphic display RAM 12 and the text display RAM 13 to the CPU 11 only when the CPU 11 designates them. In this case, addresses are designated from the address bus 16, and the data are written through the data bus 14 to the graphic display RAM 12 and the text display RAM 13. Since the address multiplexer 15 is switched to the address designation from a sync signal generation circuit 17 in a state where there is no address designation from the CPU 11, then the address is periodically designated from the sync signal generation circuit 17 to the graphic display RAM 12 and the text display RAM 13. In accordance with the designated addresses, the graphic data and the text data are outputted simultaneously.

The graphic display RAM is capable of optionally reading and writing as usual and, in this embodiment, 3 bits of the output data correspond to one dot on the CRT screen. The color of the dot is determined by the combination of the 3 bits. The combination of the color is defined in, for instance, as shown in FIG. 3, in the form of the Table. Furthermore, the text display RAM 13 is also capable of reading and writing at will and 3 bits of its output correspond to one dot. As described above, the text display RAM 13 stores the code data and character data such as an alphanumeric code are outputted from a character generator 18 based on the code issued from the RAM 13. The parallel signals thus issued are converted into serial signals by a parallel-serial converter 19 and inputted into a color designation output circuit 21, by which a color is designated by the unit of a character based on the output data from a text color designation RAM 20 connected to the data bus. It should be noted that 3 parallel bit RGB signals responsive to a predetermined sync signal correspond to one dot.

A data selection RAM 22 is written with data in parallel bits from the CPU 11 by way of the data bus 14. The RAM 22 is also connected to each of the output lines from the graphic display RAM 12 and receives 3 RGB bits from the graphic RAM 12 as the address data. Accordingly, the minimum capacity required for the RAM 22 may be 8 bits. Each of the lines of the data bus 14 is connected as the input data line for each bit. Prior to the display, data are set by way of the data bus 14 to the RAM 22 under the control of the microcomputer 11. The data thus set can be called as a monitor signal M to the microcomputer 11 at any time under the control of the microcomputer 11. Upon screen display, when the data selection RAM 22 is addressed by the 3 RGB bits of the graphic display RAM 12, it selectively outputs one bit of the set data. The selected one bit data S is once latched in a latch circuit **22*a* which receives a predetermined sync signal from the sync signal generation circuit 17 and, thereafter, is inputted to a multiplexer 23 as a data switching means (if the data selection RAM 22 incorporates a latch circuit, it may be used as the latch circuit 22*a***).

The multiplexer 23 functions to switchingly output either the output data from the graphic display RAM (3 RGB bits) or the data from the color designation output circuit 21, that is, the data from the text display RAM 13 (3 RGB bits) outputted simultaneously with the output data from the RAM 12 under the control of the 1 bit data S. Specifically, the 1 bit data S forms a switching signal for the data read out from both of the RAMs 12, 13. By applying the single RGB color signal selected and outputted from the multiplexer 23 together with a horizontal sync signal and a vertical sync signal (which may be a composite sync signal) from the sync signal generation circuit 17 to the monitor TV, graphic and/or character color display is made on the CRT screen.

Description will be made with respect to the priority order for the output from the graphic display RAM 12 and from the text display RAM 13 to the screen while referring to FIGS. 2, 4 and 5. Assume that the data bus 14 is an 8 bit bus, the signal of bits to be outputted from the 8 bits of the data bus is determined based on the 3 bits inputted now into the data selector 22. The relation between the RGB bits and the output S is shown in FIG. 4 while assuming the data bus bits as D0–D7 and 3 bit inputs to the data selection RAM 22 as RGB. When the bits D0–D7 are set by means of the key input or from a program incorporated in the microcomputer 11 by way of the data bus 14 and when RGB bits are outputted from the graphic display RAM 12, it is determined as to whether the signal from the graphic display RAM 12 or the signal from the text display RAM 13 is to be outputted to the monitor TV.

Assume that the signal from the graphic display RAM 12 is outputted if the switching signals S to the multiplexer 23 is "1" and the signal from the text display RAM 13 is outputted if the switching signal S is "0" and further that selection data "01001101" are given specifically for D0–D7 from the CPU 11. In this case, the relation between the RGB input and the output S is as shown in FIG. 5. If RGB (="010") is outputted from the graphic display RAM 12, since the output S is "1", the multiplexer 23 issues the output of the graphic display RAM 12, that is, "010", wherein the green dot is displayed. Then, if RGB (="111") is issued, since the output S is now "0", the multiplexer 23 issues the output data from the text display RAM 13, for example, "001", wherein the character display on the screen is red.

In this way, the relation for the magnitude or the priority order between the color of the dot from the graphic display RAM 12 and the output from the text display RAM 13 (viewed from the screen) is determined by the data set to the data selection RAM 22. Accordingly, where 8 color bars are outputted and a moving body of a specified color is provisionally moved on the screen, the moving body appears or disappears depending on the kind of the color bars. FIG. 5 shows one example for the input and output, but combinations of $2^8=256$ cases are possible for superimposing colors and the text while considering the arrangement of D0–D7 bits. Thus, there can be provided a large degree of freedom for superimposing the graphic display RAM data and the text display RAM data and, furthermore, such degree can optionally be controlled by the data set from the microcomputer.

In the foregoing embodiment according to this invention, a random access memory is employed as the data selection means for selectively switching the screen data simultaneously read out from the graphic display RAM and from the text display RAM by the dot unit. The data selection means alternatively may be a data selector comprising a plurality of latch circuits (composed of individual ICs), and other discrete components such as IC, resistors and capacitors in a modified embodiment. However, the data selection means may, desirably, comprise a RAM since it enables a more compact circuit structure and the priority order for the data on the screen display can always be monitored from the CPU.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A display system for a microcomputer comprising:

a graphics display RAM for storing graphic data as a 3-bit red, green, blue (RGB) color signal for each pixel of graphic data;

a text display RAM for storing text data;

a keyboard for inputting said graphic and text data as well as display instructions;

a color monitor for displaying color pixels of both said graphic and text data thereon;

multiplexer means for reading out said graphic and text data from said graphic display and text display RAMs to said color monitor;

priority read out means including a data select RAM for storing priority bit signals for selectively reading out either said graphic data or text data for given pixels of displayed information, said priority bit signals being addressed in said data select RAM by said RGB color signals stored in said graphic display RAM and output to said multiplexer means.

2. The display system of claim 1 further comprising:

character code generator means for generating a character code for reading out 8×8 pixel blocks of textual display information from said text display RAM;

color look-up memory means for storing color address information related to said text data in said text display RAM; and color designation circuit means responsive to both said character codes and said color address information for outputting text data and color signals associated therewith to said color monitor.

* * * * *